US005966889A

United States Patent [19]

Zinner

[11] Patent Number: 5,966,889

[45] Date of Patent: Oct. 19, 1999

[54] AFTER WET ADHESION BUILDING BLOCK SYSTEM

[76] Inventor: Shaul Zinner, 13 Bavli Street, Tel Aviv, Israel

[21] Appl. No.: 08/903,275

[22] Filed: Jul. 7, 1997

[51] Int. Cl.[6] ..... E04B 1/04

[52] U.S. Cl. ..... 52/606; 52/745.21; 52/747.12; 156/308.8

[58] Field of Search ..... 52/745.09, 745.21, 52/747.1–474.12, 606; 156/305, 308.8, 314, 318, 324.4

[56] References Cited

U.S. PATENT DOCUMENTS

| | | | |
|---|---|---|---|
| 979,913 | 12/1910 | Ault . | |
| 2,294,776 | 9/1942 | Freeman . | |
| 3,704,564 | 12/1972 | Koga | 52/747.12 |
| 3,995,401 | 12/1976 | Smith | 52/745.21 X |
| 5,715,635 | 2/1998 | Sherwood | 52/747.1 X |

FOREIGN PATENT DOCUMENTS

| | | |
|---|---|---|
| 528025 | 4/1954 | Belgium . |
| 270011 | 5/1927 | United Kingdom . |

*Primary Examiner*—Carl D. Friedman
*Assistant Examiner*—Timothy B. Kong
*Attorney, Agent, or Firm*—Merrill N. Johnson

[57] ABSTRACT

An after-wet-adhesion building-block system has building blocks (1) with moisture-conveyance means from outside surfaces (4) to adhesive material (3) in a dry state between the building blocks for set-up adhesion after construction. The moisture-conveyance means can be design moisture porosity of the building blocks or such features as moisture-conveyance sections (16), moisture-conveyance contact surfaces of blocks, or moisture-conveyance material (13) intermediate the building blocks. The adhesive in a dry state can be pre-applied, applied with a brush or other applicator, contained in a paper or other moisture-conveyance material that is laid on the blocks successively during construction, sprinkled on with an applicator, or applied otherwise in a dry state. In addition to using building blocks or bricks with standard shapes, a wide selection of tongue-and-groove structure (7, 8) of different types of building blocks can be employed with this invention because integrity and accuracy of tongue-and-groove positioning of building blocks is not sacrificed to bulk of mortar and to liquescent escape of wet-mixed mortar.

6 Claims, 2 Drawing Sheets

AFTER WET ADHESION BUILDING BLOCK SYSTEM

BACKGROUND OF THE INVENTION

1. Field of the Invention.

This invention relates to building with concrete or similar blocks and in particular to positioning adhesive material in a dry state between building blocks during construction and then adding water externally after part or all of a structure is completed to activate the dry adhesive material.

2. Relation to Prior Art

Currently, concrete, cinder, clay or other block building is accomplished by positioning wet mortar or other adhesive in a wet condition on contact surfaces of blocks successively. Keeping the blocks horizontally level requires considerable skill, care and time as a result of thickness of the wet mortar or other adhesive material required. Conventionally, skilled labor is employed to variously manipulate building blocks into position along leveling lines set by bubble levels continuously. The problem is compounded by liquescent travel of the wet mortar or other adhesive laterally at uneven rates without adequate control after being positioned accurately. Then when a building or section of a building settles by drying and by a small but critical level of liquescent side-escape of the wet mortar or other wet adhesive, the structure is not reliably even and horizontal. Further yet, the settled building or section of building often cracks as a result of uneven sinking of the building blocks into the wet and side-escaped mortar or other wet adhesive.

These are problems of conventional block building that increase costs of construction by requirement of skilled labor for their solution. The amount and time of skilled labor is increased by the use of wet mortar or other wet adhesive. Wet mortar applied by skilled labor appears to be a carryover from bricklaying that was not as readily amenable to after-wetting because the brick was not sufficiently porous for post-structure absorbency and conveyance of moisture to adhesive in a dry state between bricks.

Use of adhesive in a dry state with after-wetting for block building can be aided by but is not dependent on mesh fittings of interlocking blocks. Interlocking block enhances structural integrity, strength and evenness with relatively less time and effort after bottom courses or layers of block have been set on a suitable foundation. After-wet adhesion with interlocking block, therefore, further decreases skill dependence. "Do-it-yourselfers" can do it more easily. In addition to costing less, less equipment is required, it is less messy and takes less time to use after-wetting adhesion.

Examples of different but related block building are described in the following patent documents. French Patent Number 528,025, issued to Mousset in 1957, described interlocking blocks for application of wet mortar in recessed interlock sections on tops of blocks into which projecting interlock sections on bottoms of successive blocks were inserted. U.S. Pat. No. 2,294,776, issued to Freeman in 1942, taught interlocking-block structure that concealed mortar but still required wet mortar. British Patent Number 270,011, issued to Hugill in 1927, described tongue-in-groove structure generally. U.S. Pat. No. 979,913, issued to Ault in 1910, taught a basic two-hole building block with a top tongue and a bottom groove for use with wet mortar.

SUMMARY OF THE INVENTION

In light of continuing need for improvement of building materials and structures to meet changing conditions, objects of this invention are to provide an after-wet-adhesion block-building system which:

Allows building blocks to be positioned accurately in succession on top of a suitable bottom foundation without unevenness resulting from sinking into and side-escape of wet mortar or other wet adhesive;

Eliminates settling cracks that result from use of wet mortar or other wet adhesive;

Eliminates wet mixing and trowel application of wet mortar or other wet adhesive;

Facilitates accuracy and ease of use of tongue-in-groove interlocking of building blocks and bricks of all shapes and sizes;

Decreases adhesive costs; and

Decreases level of skill-dependence for building with all types of blocks and bricks.

This invention accomplishes these and other objectives with an after-wet-adhesion building-block system having building blocks with moisture-conveyance means from outside surfaces to adhesive material in a dry and optionally powdered state between the building blocks for set-up adhesion by wetting outside surfaces of a structure after its construction. The moisture-conveyance means can be design moisture porosity of the building blocks or such block-structural features as moisture-conveyance sections, moisture-conveyance contact surfaces of blocks, or moisture-conveyance material intermediate the building blocks. The adhesive in a dry state can be pre-applied, applied with a brush or other applicator during construction, contained in a paper or other moisture-conveyance material that is laid on the blocks successively during construction, sprinkled on with a shaker, or applied otherwise in a dry state. In addition to building blocks and bricks with standard shapes, a wide selection of tongue-and-groove structure of different types of building blocks can be employed with this invention because integrity and accuracy of tongue-and-groove positioning of building blocks is not sacrificed to bulk and liquescent escape of wet-mixed mortar.

BRIEF DESCRIPTION OF DRAWINGS

This invention is described by appended claims in relation to description of a preferred embodiment with reference to the following drawings which are described briefly as follows:

DESCRIPTION OF PREFERRED EMBODIMENT

Figure 1:
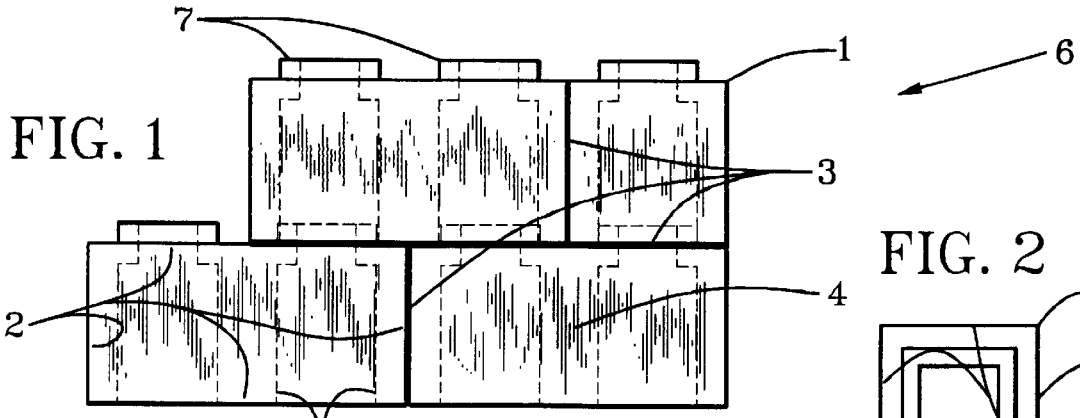
FIG. 1 is a side view of a section of a structure made with tongue-and-groove building blocks.

Reference is made first to FIGS. 1–4. Building blocks 1 having structurally joinable surfaces 2 are bondable together with adhesive material 3. The adhesive material 3 is positioned on the joinable surfaces 2 in a dry and nonadhesive state that is activated to an adhesion-setup state by liquid that can be conveyed from outside surfaces 4 of the building blocks 1 to the structurally joinable surfaces 2 with the liquid conveyance means. The dry, non-adhesive state of the adhesive material 3 can be a powder form, a flattened hard form, a plastic form or a variously molded form for particular use conditions.

The liquid conveyance means is preferably a level of porosity of block-material concrete 5 and/or filler material for the block-material concrete 5 which allows seepage of water or other design wetting liquid to adhesive material 3 that has been positioned intermediate the joinable surfaces 2 of the building blocks 1 in a process of forming an intended structure 6 or intended portion of a structure 6.

Conventionally shaped cement building blocks 1 are illustrated for construction in FIGS. 3–6. However, standard building blocks 1 can be either insufficiently porous to convey adequate moisture or too porous for particular constituencies of the adhesive material 3. The amount of liquid with which a structure 6 is wetted to activate the adhesive material 3 can be adjusted to porosity of the building block 1. Also, porosity of building blocks 1 can be adjusted to availability of water or other wetting liquid for particular areas and economic conditions.

Figure 2:
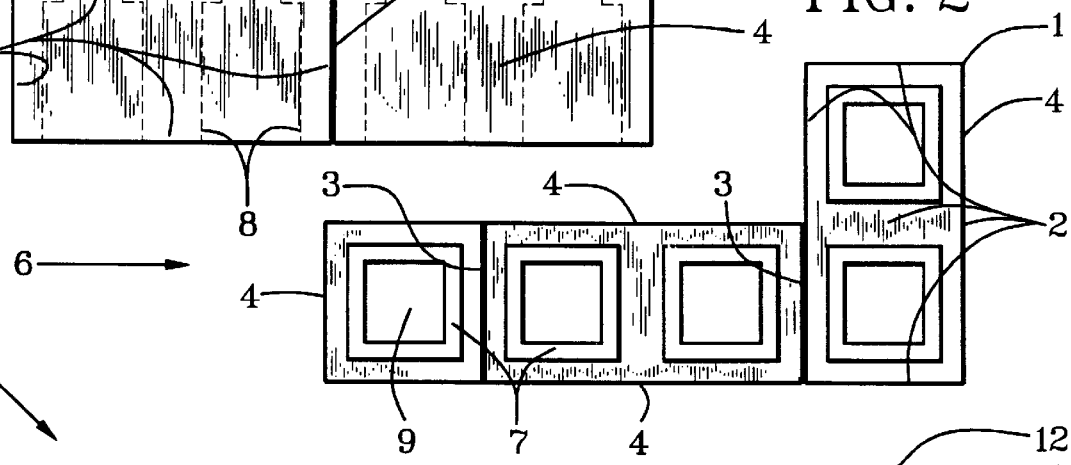
FIG. 2 is a top view of the FIG. 1 illustration.
Figure 3:
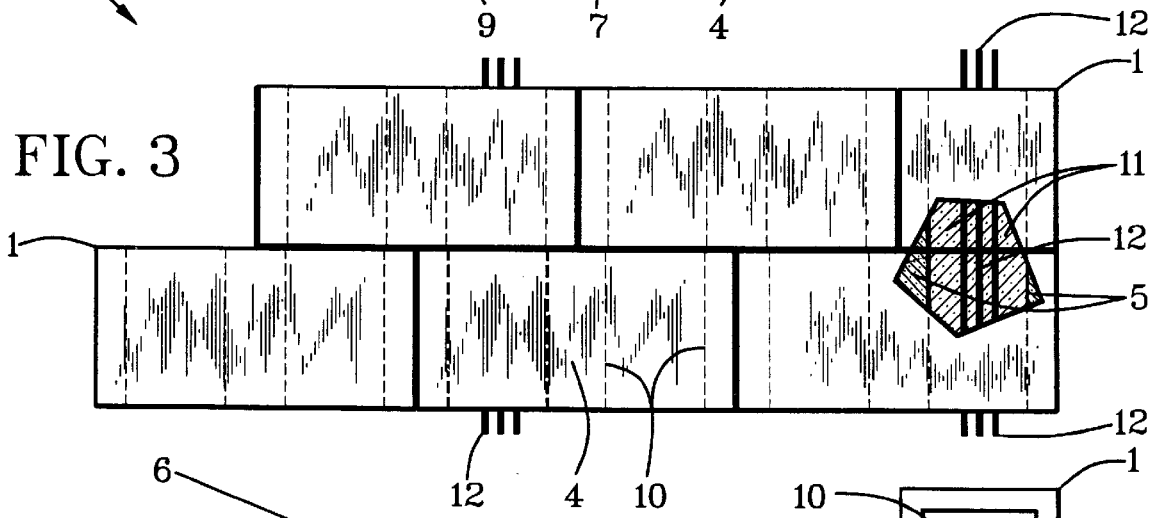
FIG. 3 is a side view of a section of a structure made with conventionally shaped building blocks.
Figure 4:
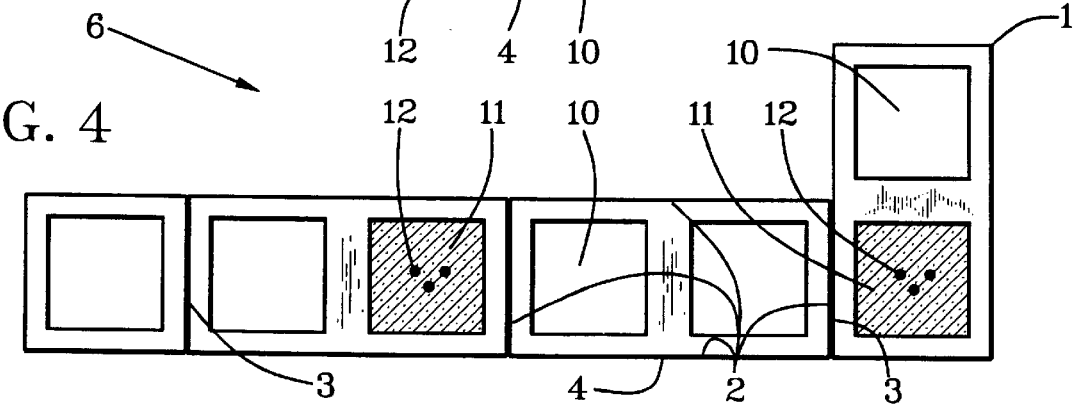
FIG. 4 is a top view of the FIG. 3 illustration.
Figure 5:
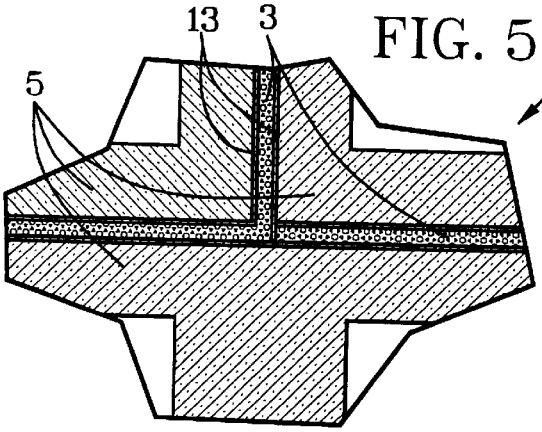
FIG. 5 is a sectional view of building blocks with adhesive material contained in porous container material that is disintegrative into adhesive material when wet.
Figure 10:
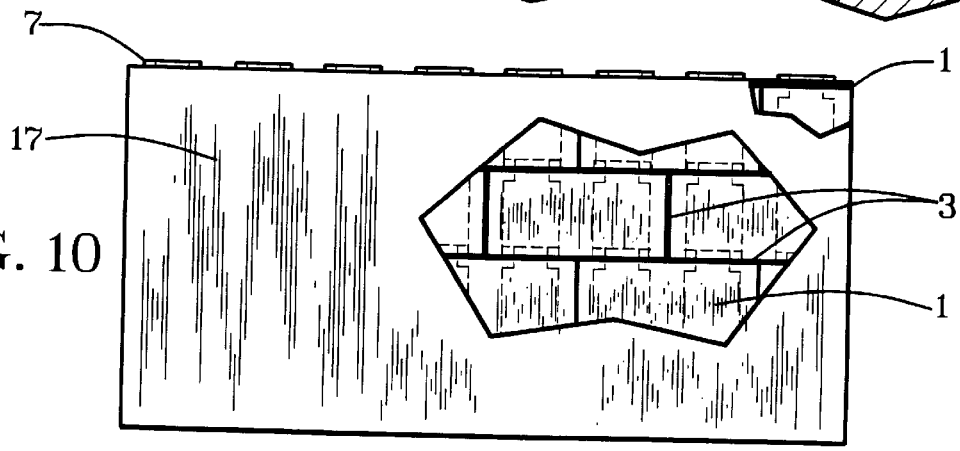
FIG. 10 is a partially cutaway elevation view of a pre-assembled stack of building blocks with adhesive material contained between them.

The building blocks 1 can be tongue-and-groove structured as illustrated in FIGS. 1–2 and 10 or structured conventionally as depicted in FIGS. 3–6. Tongues 7 can be rectangular protrusions that fit into rectangular grooves 8 at borders of contoured block holes 9 that have been suitably structured differently from standard block holes 10 in building blocks 1. Outside dimensions of building blocks 1 with tongues 7 and grooves 8 can be adjusted precisely to thickness of dry adhesive material 3 with moisture added. Adjustment or outside dimensions also can be made for corner construction of structures 6.

The tongues 7 and grooves 8 are a form of structural enforcement that is alternative to reinforced concrete 11 with reinforcement rods 12 positioned in typically every few vertical lines of block holes 10 as required by law in some areas as a result of recent hurricanes. They are effective also for earthquakes when tied to suitable roof structure as required for hurricane areas. In addition to withstanding hurricanes, many lives can be saved in earthquakes with this type of reinforcement in combination with adequate tie-down of roofing and walls to firm foundations.

Figure 8:
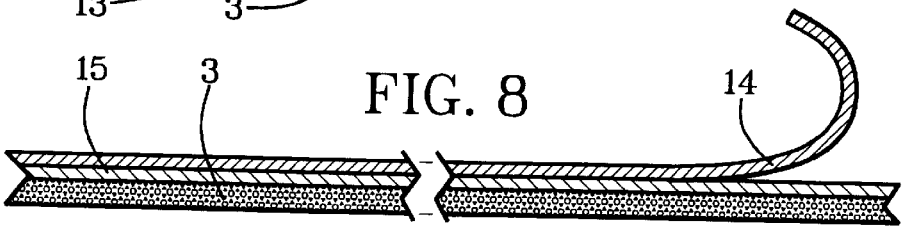
FIG. 8 shows a waterproof layer being separated from porous sheeting as a cover on dry adhesive material prior to being wet for setup into an adhesive state.
Figure 9:
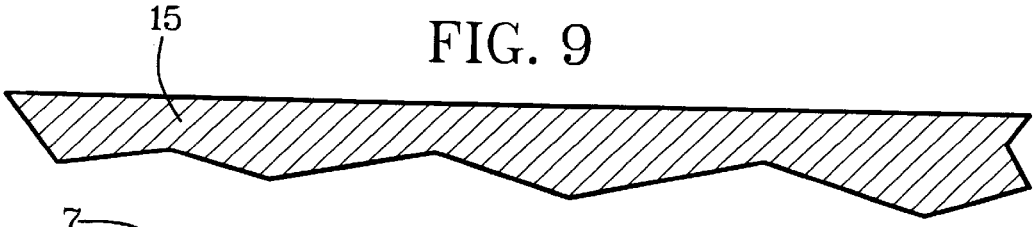
FIG. 9 is a top section of the sheeting shown in FIG. 8.

Referring to FIGS. 5–10, the adhesive material 3 can be handled and positioned in container material 13 that can be either removed after being used to position the adhesive material 3 or it can be disintegrative to form part of the adhesive material when wetted. The container material 13 can be covered with a waterproof layer 14 that can be peeled off as shown in FIG. 8 if the container material 13 is likely to be exposed to liquid prior to construction. A covering on the adhesive material 3 can be a sheeting material 15 as depicted in FIGS. 8–9.

Container or containment material 13, a waterproof layer 14 and sheeting material 15 can be used to handle, to store, to distribute and to position the adhesive material 3 with any kind of building block 1, including bricks and cement blocks that are made with filler that is too fine, like clay, for adequate porosity to convey liquid to the adhesive material 3. Containment materials 13 in which the adhesive material 3 is conveyed and positioned can be sufficiently porous to convey liquid to the adhesive material 3, regardless of level of porosity of the building block 1.

Bricklaying, is an alternative use for this invention. It permits use of nonporous building blocks 1, regardless of their size. Proportionally, bricks are similar in shape to cement building blocks 1 but smaller. Cement building blocks 1 are, in effect, large bricks that are hollowed for ease of handling and for acceptance of reinforcement through concentric vertical apertures. Structural preferences for either the airtightness of bricks or non-porous building blocks 1 can be satisfied with this invention as well as preferences for porous building blocks 1 that can be less expensive in some areas and economic conditions.

Figure 6:
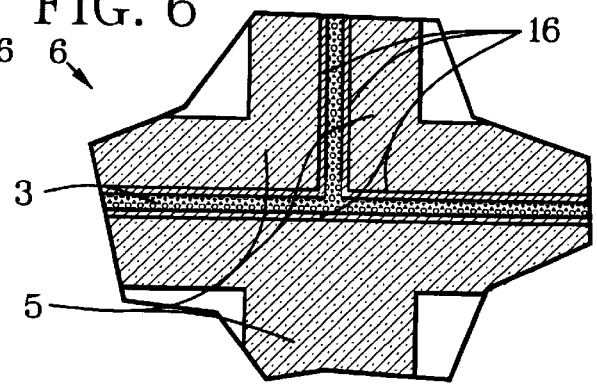
FIG. 6 is a sectional view of building blocks with porous surfacing material on structurally joinable surfaces of building blocks that are not sufficiently porous for seepage of setup liquid to adhesive material in a dry state between the building blocks or bricks.
Figure 7:
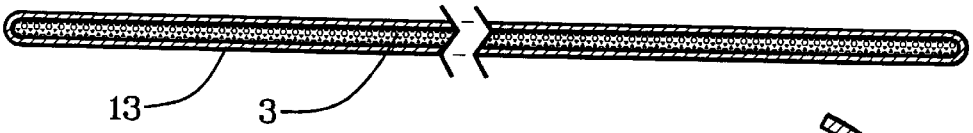
FIG. 7 is adhesive material in a container that can be porous or nonporous for being handled and positioned between building blocks or bricks.

Also for building blocks 1 or bricks that are non-porous or insufficiently porous, porous surfacing material 16 can be positioned on the joinable surfaces 2, as depicted in FIG. 6, with or without containment material 13 described in relation to FIGS. 5 and 7–9.

Referring to FIG. 10, the adhesive material 3 in a dry state can be pre-positioned between joinable surfaces 2 of building blocks 1 and then stored, handled and positioned in waterproof containers 17, regardless of size, porosity or structure. In some areas and economic conditions, particularly where lift forks are readily available, this is a form of prepackaged assembly that can be a labor-saving feature. The waterproof containers 17 can be cut and/or stripped away from sections of structures 6 after being properly positioned for building.

After-wetting liquid is preferably water but can be any liquid which an adhesive material 3 is made to accept as a setup liquid. The adhesive material 3 can be made to be set up for hardening with liquids with such agents as various types of polymers, salts and acids. Some setup liquids can be used also as surface sealing against porosity of the buildings after their construction. Some adhesive material 3 also can be made to provide sealant in lieu of paint or stucco when applied to outside edges of walls and wetted for wetting the adhesive material 3 between the building blocks 1. For setup wetting that sets up adhesive material 3 between building blocks 1 and on outside vertical surfaces of structures 6, the adhesive material 3 can be applied to the outside vertical surfaces of structures 6 on outside surfaces 4 of building blocks 1 after the wetting has been accomplished and there is still sufficient wetness for adherence and hardening of the adhesive material 3.

A new and useful an after-wet-adhesion building-block system having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. An after-wet-adhesion building-block system comprising:

building blocks capable of being connected to one another having structurally joinable surfaces;

liquid-conveyance means in fluid communication from outside surfaces of the building blocks to the structurally joinable surfaces of the building blocks in;

adhesive material in a dry and nonadhesive state that is activated to an adhesion-setup state by liquid that can be conveved from outside surfaces of the building blocks to the structurally joinable surfaces of the building blocks with the liquid-conveyance means;

the adhesive material for positioning in a dry state intermediate the structurally loinable surfaces of the building blocks;

the adhesive material is a water-activated adhesive;

wherein the building blocks are concrete building blocks; and the liquid-conveyance means is a level of porosity of the concrete building blocks which allows seepage of water as moisture to the water-activated adhesive.

2. An after-wet-adhesion building-block system comprising;

building blocks capable of being connected to one another having structurally Joinable surfaces;

liquid-conveyance means in fluid communication from outside surfaces of the building blocks to the structurally Joinable surfaces of the building blocks of a structure;

adhesive material in a dry and nonadhesive state that is activated to an adhesion-setup state by liquid that can be conveyed from outside surfaces of the building blocks to the structurally joinable surfaces of the building blocks with the liquid-conveyance means;

the adhesive material for positioning in a dry state intermediate the structurally joinable surfaces of the building blocks;

the adhesive material is a water-activated adhesive;

the building blocks are concrete building blocks;

formed with the building blocks;

the building blocks are made of material with insufficient porosity to convey water to the water-activated adhesive from water available to be directed onto a surface of an intended structure or intended portion of a structure formed with the building blocks;

the liquid-conveyance means is moisture-conveyance material for positioning adjacent to the water-activated adhesive intermediate the structurally joining surfaces of the building blocks;

the moisture-conveyance material is packaging material in which the water-activated adhesive is handled and is for positioning intermediate the structurally Joining surfaces of the building blocks;

wherein the moisture-conveyance material is sheeted material that disintegrates into an adhesive-set up state with the adhesive material when wetted.

3. An after-wet-adhesion building-block system comprising:

building blocks capable of being connected to one another having structurally joinable surfaces:

liquid-conveyance means in fluid communication from outside surfaces of the building blocks to the structurally joinable surfaces of the building blocks;

adhesive material in a dry and nonadhesive state that is activated to an adhesion-setup state by liquid that can be conveyed from outside surfaces of the building blocks to the structurally joinable surfaces of the building blocks with the liquid-conveyance-means;

the adhesive material is a water-activated adhesive;

each said building block having a tongue member and a groove member, wherein said tongue member of one said block is engageable with said groove member of another said block, and wherein when said blocks are so engaged, a gap is created between said blocks to allow for insertion of said water-activated adhesive;

wherein the building blocks are concrete building blocks; and the liquid-conveyance means is a level of porosity of the concrete building blocks which allows seepage of water as moisture to the water-activated adhesive.

4. An after-wet-adhesion building-block system comprising:

building blocks capable of being connected to one another having structurally joinable surfaces:

liquid-conveyance means in fluid communication from outside surfaces of the building blocks to the structurally joinable surfaces of the building blocks;

adhesive material in a dry and nonadhesive state that is activated to an adhesion-setup state by liquid that can be conveyed from outside surfaces of the building blocks to the structurally joinable surfaces of the building blocks with the liquid-conveyance-means;

the adhesive material is a water-activated adhesive;

the building blocks are concrete building blocks;

the liquid-conveyance means is a level of porosity of the concrete building blocks which allows seepage of water as moisture to the water-activated adhesive;

each said building block having a tongue member and a groove member, wherein said tongue member of one said block is engageable with said groove member of another said block, and wherein when said blocks are so engaged, a gap is created between said blocks to allow for insertion of said water-activated adhesive;

the moisture-conveyance material is packaging material in which the water activated adhesive is handled and is for positioning intermediate the structurally joining surfaces of the building blocks; and wherein the moisture-conveyance material is sheeted material that disintegrates into an adhesive-setup state with the adhesive material when wet.

5. An after-wet-adhesion building-block system comprising:

building blocks capable of being connected to one another having structurally joinable surfaces:

liquid-conveyance means in fluid communication from outside surfaces of the building blocks to the structurally joinable surfaces of the building blocks;

adhesive material in a dry and nonadhesive state that is activated to an adhesion-setup state by liquid that can be conveyed from outside surfaces of the building blocks to the structurally joinable surfaces of the building blocks with the liquid-conveyance-means;

the adhesive material is a water-activated adhesive;

the building blocks are concrete building blocks;

the liquid-conveyance means is a moisture-conveyance material for positioning adjacent to the water activated adhesive intermediate structurally joining surfaces of the building blocks;

the moisture-conveyance material is packaging material in which the water activated adhesive is handled and is for positioning intermediate the structurally joining surfaces of the building blocks;

the moisture-conveyance material is sheeted material that disintegrates into an adhesive-setup state with the adhesive material when wet;

the moisture-conveyance material is porous surfacing material on the structurally joining surfaces of the building blocks;

each said building block having a tongue member and a groove member, wherein said tongue member of one said block is engageable with said groove member of another said block, and wherein when said blocks are so engaged, a gap is created between said blocks to allow for insertion of said water-activated adhesive;

the tongue members are ridge members proximate outside edges of first sides of rectangular orifices in said building blocks;

the groove members are recesses proximate outside edges of second sides of the rectangular orifices in said building blocks;

the recesses are structured to receive the tongue members and the tongue members are structured to be inserted into the recesses with sufficient contact to aid in the structural integrity of the intended structure when said structure is constructed;

the water-activated adhesive is for positioning on at least one of the structurally joinable surfaces and is covered with a containment material to contain the water-activated adhesive in place for water-activation after being assembled with other building blocks; and wherein the containment material is covered with water-repellant material that is detachable form the containment material on separate building blocks while said building blocks are being positioned.

6. An after-wet-adhesion building-block system comprising:

building blocks capable of being connected to one another having structurally joinable surfaces:

liquid-conveyance means in fluid communication from outside surfaces of the building blocks to the structurally joinable surfaces of the building blocks;

adhesive material in a dry and nonadhesive state that is activated to an adhesion-setup state by liquid that can be conveyed from outside surfaces of the building blocks to the structurally joinable surfaces of the building blocks with the liquid-conveyance-means;

the adhesive material is a water-activated adhesive;

the building blocks are concrete building blocks;

the liquid-conveyance means is a moisture-conveyance material for positioning adjacent to the water activated adhesive intermediate structurally joining surfaces of the building blocks;

the moisture-conveyance material is packaging material in which the water activated adhesive is handled and is for positioning intermediate the structurally joining surfaces of the building blocks;

the moisture-conveyance material is sheeted material that disintegrates into an adhesive-setup state with the adhesive material when wet;

the moisture-conveyance material is porous surfacing material on the structurally joining surfaces of the building blocks;

each said building block having a tongue member and a groove member, wherein said tongue member of one said block is engageable with said groove member of another said block, and wherein when said blocks are so engaged, a gap is created between said blocks to allow for insertion of said water-activated adhesive;

the tongue members are ridge members proximate outside edges of first sides of rectangular orifices in said building blocks;

the groove members are recesses proximate outside edges of second sides of the rectangular orifices in said building blocks;

the recesses are structured to receive the tongue members and the tongue members are structured to be inserted into the recesses with sufficient contact to aid in the structural integrity of the intended structure when said structure is constructed;

the water-activated adhesive is for positioning on at least one of the structurally joinable surfaces and is covered with a containment material to contain the water-activated adhesive in place for water-activation after being assembled with other building blocks; and wherein the structurally joinable surfaces of the building blocks have said containment material thereon and said containment material is covered by a detachable water-repellent material which is detached prior to the positioning of the building blocks during assembly thereof.

* * * * *